US005094729A

United States Patent [19]

Klotz et al.

[11] Patent Number: 5,094,729

[45] Date of Patent: Mar. 10, 1992

[54] PROCESSES FOR THE PREPARATION OF ALKALI METAL DICHROMATES AND CHROMIC ACID

[75] Inventors: Helmut Klotz, Bergisch Gladbach; Hans D. Pinter, Pulheim; Rainer Weber, Leverkusen; Hans-Dieter Block, Leverkusen; Norbert Lönhoff, Leverkusen, all of Fed. Rep. of Germany

[73] Assignee: Bayer Aktiengesellschaft, Leverkusen, Fed. Rep. of Germany

[21] Appl. No.: 659,435

[22] Filed: Feb. 22, 1991

Related U.S. Application Data

[63] Continuation of Ser. No. 392,815, Aug. 11, 1989, abandoned.

[30] Foreign Application Priority Data

Aug. 27, 1988 [DE] Fed. Rep. of Germany ..... 3829123

[51] Int. Cl.[5] ..... C25B 1/22; C25B 1/00

[52] U.S. Cl. ..... 204/89; 204/97; 204/130

[58] Field of Search ..... 204/89, 130, 97, 59 R; 134/42

[56] References Cited

U.S. PATENT DOCUMENTS 1,878,918 9/1932 Udy ..... 204/97
2,333,578 11/1943 Knox, Jr. et al. ..... 204/89
3,305,463 2/1967 Carlin ..... 204/89

FOREIGN PATENT DOCUMENTS 0739447 7/1966 Canada .
2051868 1/1981 United Kingdom .

OTHER PUBLICATIONS

Chemical Abstracts, Band, Band 87, Nr. 20, Nov. 14, 1977, Seite 463, Zusammenfassung Nr. 159202k, Columbus, Ohio, U.S.; & JP-A-77 81 097 (K. Saito) 07-0-7-1977.

Ullmann's Encyclopedia of Industrial Chemistry, 5th Edition, vol. A7: Chlorophenols to Copper Compounds, 1986, pp. 67-97.

*Primary Examiner*—John Niebling
*Assistant Examiner*—Kathryn Gorgos
*Attorney, Agent, or Firm*—Sprung Horn Kramer & Woods

[57] ABSTRACT

A process for the preparation of alkali metal dichromates and chromic acid by the electrolysis of monochromate and/or dichromate solutions in an electrolytic cell in which the anode and cathode chamber are separated by a cation exchanger membrane anolyte fluid containing dichromate and/or chromic acid being formed in the anode chamber and alkaline catholyte fluid containing alkali metal ions being formed in the cathode chamber, the improvement wherein the catholyte fluids are periodically replaced by a solution which is at a pH below 6.

5 Claims, No Drawings

PROCESSES FOR THE PREPARATION OF ALKALI METAL DICHROMATES AND CHROMIC ACID

This application is a continuation of application Ser. No. 392,815, filed Aug. 11, 1989, now abandoned.

BACKGROUND OF THE INVENTION

1. Field of the Invention

This invention relates to processes for the preparation of alkali metal dichromates and chromic acid by the electrolysis of monochromate and/or dichromate solutions in electrolytic cells in which the anode and cathode chambers are separated by cation exchanger membranes, an anolyte fluid containing dichromate and/or chromic acid being formed in the anode chamber and an alkaline catholyte fluid containing alkali metal ions being formed in the cathode chamber.

2. Description of Related Art

According to U.S. Pat. No. 3,305,463 and CA-A-739,447, the electrolytic preparation of alkali metal dichromates and chromic acid ($CrO_3$) is carried out in electrolytic cells in which the electrode chambers are separated by a cation exchanger membrane.

Alkali metal dichromates are prepared by introducing alkali metal monochromate solutions or suspensions into the anode chamber of the cell where they are converted into an alkali metal dichromate solution by selective transfer of alkali metal ions into the cathode chamber through the membrane. For the preparation of chromic acid, alkali metal dichromate or alkali metal monochromate solutions or a mixture of alkali metal dichromate and monochromate solutions are introduced into the anode chamber and converted into solutions containing chromic acid. Sodium monochromate solutions and/or sodium dichromate solutions are generally used for these processes.

For the production of alkali metal dichromate crystals or chromic acid crystals, the solutions formed in the anode chambers of the cells are concentrated by evaporation: the crystallization of sodium dichromate, for example, may take place at 80° C. and the crystallization of chromic acid at 60°-100° C. The crystallized products are separated off, optionally washed and dried.

In both processes, an alkaline catholyte fluid containing alkali metal ions is obtained in the cathode chamber. This catholyte fluid may consist of, for example, an aqueous sodium hydroxide solution or, as described in CA-A-739 447, of an aqueous solution containing sodium carbonate.

In the course of the process, deposits of compounds of polyvalent ions, in particular of alkaline earth compounds are formed, which impair the functional efficiency of the membrane within a short time until the membrane completely fails. The formation of these deposits is due to the presence of small amounts of polyvalent cations, in particular of calcium and strontium ions, in the alkali metal dichromate and/or alkali metal monochromate solutions used as electrolytes, such as those obtainable by industrial processes described in Ullmann's Encyclopedia of Industrial Chemistry, 5th Edition, Volume A 7, 1986, pages 67-97.

The object of this invention was to provide processes for the preparation of alkali metal dichromate and chromic acid by electrolysis which would be free from the disadvantages described above.

SUMMARY OF THE INVENTION

It has now surprisingly been found that the abovementioned disadvantages do not occur if the catholyte fluid is periodically replaced by a solution having a pH below 6.

This invention, thus, relates to processes for the preparation of alkali metal dichromates and chromic acid by the electrolysis of monochromate and/or dichromate solutions in electrolytic cells in which the anode and cathode chambers are separated by cation exchanger membranes, anolyte fluids containing dichromate and/or chromic acid being formed in the anode chamber and alkaline catholyte fluids containing alkali metal ions being formed in the cathode chamber, characterized in that the catholyte fluids are periodically replaced by a solution which is at a pH below 6.

DESCRIPTION OF THE PREFERRED EMBODIMENTS

The process according to the invention is carried out with an electrolytic current. The catholyte fluids are preferably replaced periodically by a solution which is at a pH below 1. Examples of suitable solutions include inorganic acids such as sulphuric acid, phosphoric acid and hydrochloric acid as well as organic acids used at various concentrations. In one particularly preferred variation, the catholyte fluids are periodically replaced by a solution containing chromic acid. It is advantageous to use a chromic acid-containing solution in which the chromic acid content is from 10 to 900 g per liter. This solution may, of course, also contain a certain amount of alkali metal dichromate.

In the process according to the invention, the catholyte fluids are preferably replaced by a solution at a pH below 6 after an electrolysis time of from 1 to 100 days. The length of time after which this measure is carried out depends on the amount of polyvalent cations present in the monochromate and/or dichromate solutions as well as on the anodic current density. If the cation content is very low, replacement of the liquid may be carried out after a period longer than 100 days.

The process according to the invention avoids the formation of deposits and any deposits present are dissolved so that the service life of the membrane is considerably increased and continuous and prolonged electrolysis is ensured.

The process according to the invention will now be described with the aid of the examples which follow.

EXAMPLES

The electrolytic cells used in the Examples consisted of anode chambers of pure titanium and cathode chambers of refined steel. The membranes used were Nafion® 324 cation exchanger membranes of DuPont. The cathodes consisted of refined steel and the anodes of expanded titanium with an electrocatalytically active layer of tantalum oxide and iridium oxide. Anodes of this type are described, for example; in U.S. Pat. No. 3,878,083.

The distance between the electrodes and the membrane was in all cases 1.5 mm. Sodium dichromate solutions containing 900 g/l of $Na_2Cr_2O_7.2H_2O$ with the impurities listed in the individual Examples were introduced into the anode chambers Water was introduced into the cathode chambers at such a rate that 20% sodium hydroxide solution was discharged from the cells. The temperature of electrolysis was in all cases 80° C.

EXAMPLE 1

The sodium dichromate solutions used in this experiment contained the following impurities:

| | |
|---|---|
| Calcium | 5 to 10 mg/l |
| Strontium | 0.5 to 1.3 mg/l |
| Magnesium | 1 to 2 mg/l |
| Silicon | 15 to 40 mg/l |
| Sulphate, $SO_4^{2-}$ | 4 to 5 g/l |

These solutions were electrolytically converted into solutions containing chromic acid in the electrolytic cell described. The current density was adjusted to 1 kA per $m^2$ of the projected surface areas of the anode and cathode facing the membrane, the surface area of the anode facing the membrane amounting to 10 cm·3.6 cm.

The speed of introduction of the sodium dichromate solutions was chosen so that a molar ratio of sodium ions to chromium(VI) of 0.8 became established in the anolyte leaving the cell. A white deposit consisting mainly of calcium hydroxide had formed after an electrolysis time of 167 days. The cell voltage at that time was 4.04 V. The anodes had to be replaced several times in the course of the electrolysis owing to insufficient durability.

The following procedure was then carried out for dissolving and removing the deposit. The cathodically formed 20% sodium hydroxide solution in the cathode chamber of the cell was first replaced by water and then by a solution at a pH below 1 containing $CrO_3$ and $Na_2Cr_2O_7 \cdot 2H_2O$. This solution had the following composition:

30.3% of $Na_2Cr_2O_7 \cdot 2H_2O$
30.3% of $CrO_3$
39.4% of $H_2O$.

After an electrolysis time of one hour, the solution in the cathode chamber was replaced, first by water and then by 20% sodium hydroxide solution. After this treatment, the white deposits were found to be almost completely removed and the cell voltage had returned to 3.73 V.

EXAMPLE 2

The sodium dichromate solution used contained the following impurities:

| | |
|---|---|
| Calcium | 8 mg/l |
| Strontium | 0.5 mg/l |
| Magnesium | 2 mg/l |
| Silicon | 27 mg/l |
| Sulphate | 5 g/l. |

Electrolytic conversion of this solution into a solution containing chromic acid was carried out at 3 kA per $m^2$ of the projected surface area of the anode, which amounted to 11.4 cm·6.7 cm. The speed of introduction of the sodium dichromate solution was adjusted so that a molar ratio of sodium ions to chromium(VI) of 0.8 became established in the anolyte leaving the cell.

After 12 days of operation of the cell combined with an increase in cell voltage from an initial 4.10 V to 5.24 V, white deposits had formed in the membrane. The procedure described in Example 1 was employed for dissolving and removing these deposits: in this case, the time of electrolysis with the solution containing $CrO_3$ and $Na_2Cr_2O_7 \cdot 2H_2O$ in the cathode chamber amounted to 10 minutes. The white deposits were for the most part removed by the treatment, as could be seen from the reduction in cell voltage to 4.85 V.

EXAMPLE 3

The sodium dichromate solutions used in this Example contained the following impurities:

| | |
|---|---|
| Calcium | 8 to 17 mg/l |
| Strontium | 0.5 to 1 mg/l |
| Magnesium | 2 to 3 mg/l |
| Silicon | 16 to 49 mg/l |
| Sulphate | 3.5 to 4.5 mg/l. |

Electrolytic conversion of these solutions took place at 3 kA/$m^2$ of the projected anode surface area of 11.4 cm·6.7 cm. The molar ratios of sodium ions to chromium(VI) in the anolyte leaving the cell were adjusted to values of from 0.46 to 0.55 by varying the speed of introduction of the sodium dichromate solutions.

White deposits had again formed in the membrane after an electrolysis time of 28 days. The cell voltage at this time was 3.96 V. The deposits were dissolved and removed as described in Example 1.

At the end of the treatment, the white deposits had been almost completely removed and the cell voltage had gone back to 3.75 V.

What is claimed is:

1. A process for the preparation of alkali metal dichromates, chromic acid, or a mixture of alkali metal dichromates and chromic acid in an electrolytic cell containing anode and cathode chambers that are separated by a cation exchanger membrane, said process comprising (1) introducing alkali metal monochromate solutions, alkali metal dichromate solutions, or a mixture of alkali metal monochromate solutions and alkali metal dichromate solutions into the anode chamber and electrolyzing said solutions to form an anolyte containing alkali metal dichromates, chromic acid, or a mixture of alkali metal dichromates and chromic acid in the anode chamber and an alkaline catholyte containing alkali metal ions in the cathode chamber and (2) periodically removing the alkaline catholyte and replacing the alkaline catholyte by an acidic solution having an pH below about 6 to achieve an overall acidic pH in the cathode chamber to thereby dissolve substantially all deposits of polyvalent cation impurities in the cation exchanger membrane.

2. A process according to claim 1, comprising periodically replacing the catholyte fluid by a solution having pH below about 1.

3. A process according to claim 2, wherein the solution at a pH below about 1 is a solution containing chromic acid.

4. A process according to claim 3, wherein the concentration of the solution containing chromic acid is from 10 to 900 g of $CrO_3$/1.

5. A process according to claim 1, comprising replacing the catholyte fluid by a solution with a pH below 6 after an electrolysis time of from 1 to 100 days.

* * * * *